US009984599B2

(12) United States Patent
White

(10) Patent No.: US 9,984,599 B2
(45) Date of Patent: May 29, 2018

(54) SIGN SUSPENDER FOR MOUNTING IN CHANNEL FOR LADDERLESS DISPLAY

(71) Applicant: Michael J. White, Ripon, WI (US)

(72) Inventor: Michael J. White, Ripon, WI (US)

(73) Assignee: K-International, Inc., Waukegan, IL (US)

( * ) Notice: Subject to any disclaimer, the term of this patent is extended or adjusted under 35 U.S.C. 154(b) by 165 days.

(21) Appl. No.: 14/638,788

(22) Filed: Mar. 4, 2015

(65) Prior Publication Data

US 2016/0265718 A1 Sep. 15, 2016

(51) Int. Cl.
*A47H 1/10* (2006.01)
*G09F 7/18* (2006.01)

(52) U.S. Cl.
CPC ..... *G09F 7/18* (2013.01); *G09F 2007/186* (2013.01)

(58) Field of Classification Search
CPC ..... G09F 2007/186
See application file for complete search history.

(56) References Cited

U.S. PATENT DOCUMENTS 2,702,176 A * 2/1955 Dulle ..... A47F 5/0892 248/323
2,966,695 A * 1/1961 Dwyer ..... A47H 15/04 16/93 D
3,616,486 A * 11/1971 Ford et al. ..... A47H 1/04 16/87.2
3,645,026 A * 2/1972 Lorch ..... G09F 17/00 40/218
4,177,961 A * 12/1979 Gruenewald ..... B65H 75/36 242/405.2
4,323,215 A * 4/1982 Berger ..... F16M 11/16 248/205.3
4,667,913 A * 5/1987 Peelle ..... A47F 5/0006 248/228.4
4,680,886 A * 7/1987 Caselli, Sr. ..... A01K 97/06 43/57.1

(Continued)

FOREIGN PATENT DOCUMENTS

EP 1625811 A2 * 2/2006 ..... A47F 5/0892
WO WO 2013154249 A1 * 10/2013 ..... G09F 7/18

OTHER PUBLICATIONS

FFR DSI—Yellow Pages 2009 Product Catalog General Merchandis Edition—1st page, pp. 200-201, and p. 205.

(Continued)

*Primary Examiner* — Amy J. Sterling
(74) *Attorney, Agent, or Firm* — Schiff Hardin LLP

(57) ABSTRACT

A ceiling clip for mounting a sign or display includes a spool portion on which is wound a cord that is selectively unwound to a desired length and attached in a line clip for suspending the sign or display from the cord. The ceiling clip includes first and second flanges wherein the second flange is shaped to fit into a channel. The second flange is tapered for insertion into the channel and is of a width to frictionally engage the channel. Multiple ceiling clips may be inserted into the channel. The channel has magnets, hooks, interlocking cleats, or other mounting means that engage a mounting location to mount the channel, ceiling clips, and the sign or display at the mounting location with a single mounting motion. The channel may be mounted or unmounted using a gripper on a pole.

17 Claims, 7 Drawing Sheets

(56) References Cited

U.S. PATENT DOCUMENTS

| | | | | | |
|---|---|---|---|---|---|
| 5,188,332 | A * | 2/1993 | Callas | G09F 7/18 | 248/206.5 |
| 5,490,651 | A * | 2/1996 | Kump | F16B 2/22 | 24/457 |
| 5,806,823 | A * | 9/1998 | Callas | G09F 15/025 | 248/317 |
| 5,924,246 | A * | 7/1999 | Jurgens | G09F 7/18 | 248/317 |
| 5,960,967 | A * | 10/1999 | Neil | A47F 5/0846 | 211/94.01 |
| 6,976,662 | B2 * | 12/2005 | Kump | E04B 9/006 | 248/222.52 |
| 9,347,213 | B1 * | 5/2016 | Zhang | E04B 1/40 | |
| 2009/0056186 | A1 * | 3/2009 | Pitcher | G09F 7/18 | 40/617 |

OTHER PUBLICATIONS

Merchandising Inventives, Inc.,—Point of Purchase Catalog, 1st page and p. 22.
Co-pending U.S. Appl. No. 14/248,899, filed Mar. 14, 2014.

* cited by examiner

FIG. 4
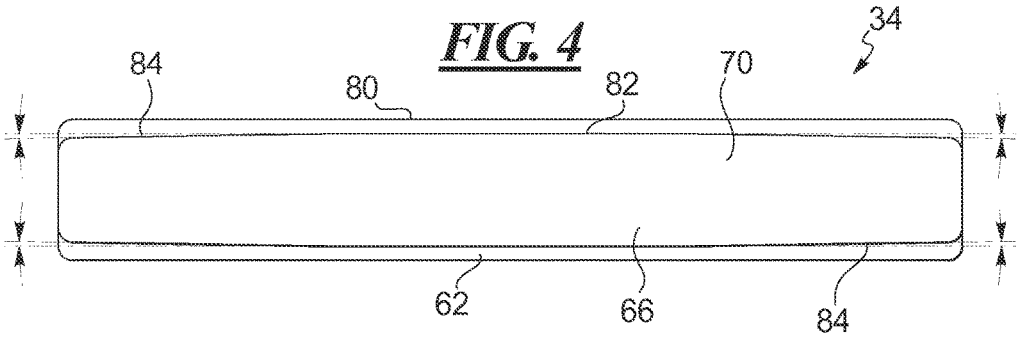
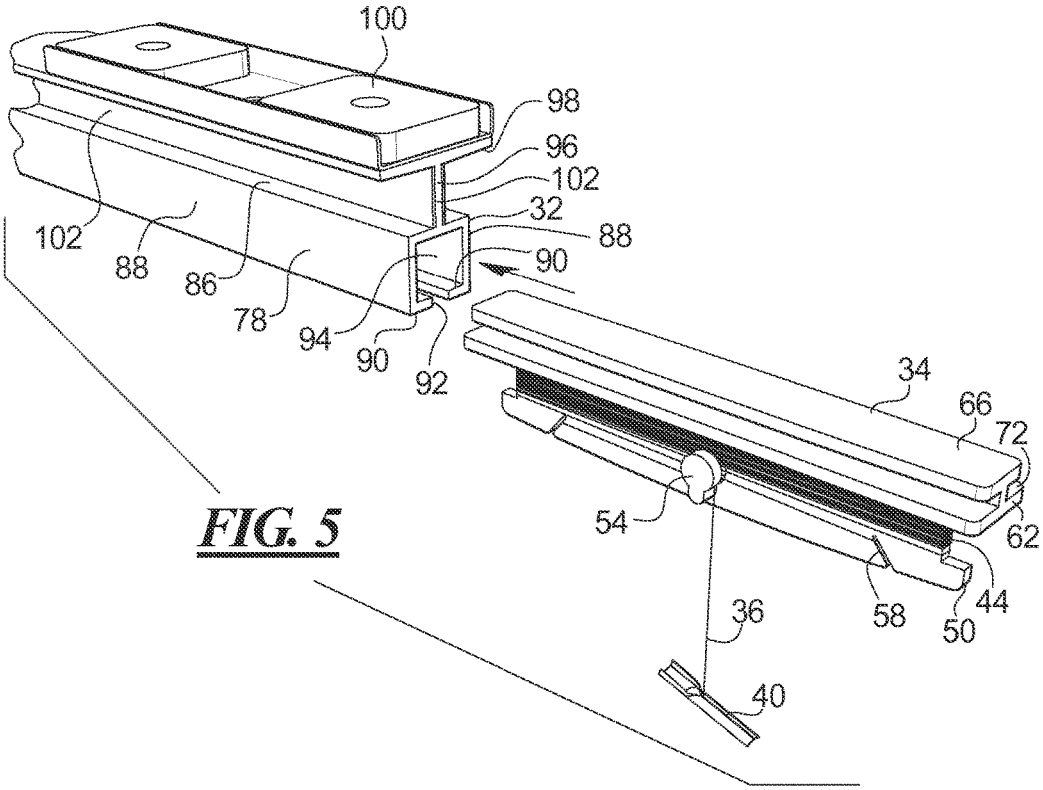
FIG. 5
FIG. 6
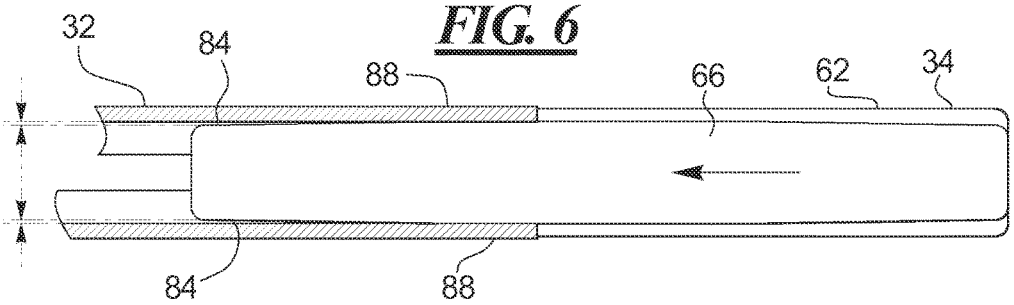

SIGN SUSPENDER FOR MOUNTING IN CHANNEL FOR LADDERLESS DISPLAY

BACKGROUND OF THE INVENTION

Field of the Invention

The present invention relates generally to a sign hanger for suspending a sign or other article, and more particularly to a sign hanger for suspending a sign or other article from a ceiling of a building or other mounting locations.

Description of the Related Art

Signs and displays are used extensively in stores, theaters, shopping centers, recreational facilities, schools, tradeshows, restaurants, and other public places. Some signs are permanent signs to direct customers and others to locations within the facility, such as to exits or restrooms. However, temporary signs and displays are frequently used to display information to the customers or others, such as to announce a sale or a new product or service, to identifying a location of an item or departments within the facility, or for other uses.

The signs or displays are preferably mounted at readily visible locations within the facility. One such visible location is to mount the sign or display suspended from a ceiling. The facility may have a ceiling that includes a metal gridwork or grid structure that supports ceiling tiles. The sign or display may be mounted to the gridwork by an employee, for example, climbing a ladder or stepping onto a box or crate to reach the gridwork so as to affix the sign or display. The risk of falling or other injury is a very real possibility, particularly if the ladder, box or crate is set on a wet or uneven floor, if the employee must reach beyond the safe limit of the ladder, or if other customers or displays are nearby so as to prevent an ideal positioning of the ladder, or simply if the employee is unsteady when climbing the ladder or atop the crate.

A sign holding and mounting device has been provided that utilizes an elongated pole to position a sign holding and mounting channel or sign holder for attachment to a ceiling grid structure using clamps on the sign holder to engage the grid structure or an elongated flexible magnet affixed to the sign holder for fastening to a ceiling grid. The sign holder channel is held in a gripper on the elongated pole, is clamped or magnetically affixed to the ceiling grid structure using the flexible magnet strip, and is released by the gripper using a rope to open a jaw on the gripper.

Displays are known that utilize a string or cord to suspend a sign or other article from the ceiling. The suspended sign or other article may be referred to as a dangler. The string or cord may be provided on a ceiling clip that may be affixed to a ceiling. An example of the ceiling clip is affixed directly to the ceiling via either a clip that fastens to the ceiling grid or a magnet on the ceiling clip that attaches to a metal portion of a ceiling grid.

A sign mounting system has been provided that includes an extruded channel that affixes to a ceiling via magnets. The extruded channel holds one or more block end hooks that fit into the channel from which a sign or display may be suspended. An example of a magnetically affixed channel with block end hooks is shown in co-pending U.S. patent application Ser. No. 14/248,899, filed Mar. 14, 2014, which is incorporated herein by reference.

SUMMARY OF THE INVENTION

The present invention provides a ceiling clip for a hanging display, where the ceiling clip may be mounted in a channel of a sign or display mounting device. The ceiling clip holds a length of cord, string, line, wire, cable, chain, loop line, or other elongated member on which a sign or other display is mounted. The channel may be mounted at a ceiling, roof beam, window, wall, or other location, thereby mounting the sign or display that is held by the ceiling clip.

One or several of the ceiling clips may be mounted in a single channel. A single sign or display may be suspended from multiple ceiling clips that are mounted in the single channel. Alternatively, a plurality of sign or display elements may be suspended from the multiple ceiling clips held in the channel. The ceiling clips may be arranged as desired along the channel to position the plurality of sign or display elements as desired. For a single sign held by multiple ceiling clips, the ceiling clips may be arranged to apply tension to the sign, to hang a sign larger than the channel, or to hang a sign by locating the ceiling clips directly above attachment locations of the sign or display.

The ceiling clips are configured to permit the user to adjust the cord, string, wire, chain, line or other elongated member to different lengths so that the display or sign is suspended at the desired distance from the mounting location of the channel. The length of the cord, string, or line suspended from the ceiling clip is adjustable in fine increments by positioning the cord in adjustment locations of the ceiling clip. The finely adjusted length increments of multiple ceiling clips mounted in a channel enables creative positioning of signs and displays hung from the channel, such as signs at multiple levels, signs at angles, or the like.

The channel may be mounted to the ceiling or removed from the ceiling to mount or unmount multiple ceiling clips in one single motion or at one time, as compared to requiring a separate mounting motion for each ceiling clip that might be mounted at different times or mounted simultaneously with two or more individuals requiring two or more elongated poles. The channel may be mounted to the ceiling or unmounted from the ceiling using an elongated pole for placement of the sign or display or removal thereof without the use of a ladder. The positions of the ceiling clips in the channel may be set to any spacing to achieve a desired suspension of the sign or other display. For example, the ceiling clips may be more widely spaced than the width of the sign so as to apply tension to the sign.

By providing multiple ceiling clips in a channel, multiple dangler hanging points may be provided from a single mounting element. One mounting motion is used to mount the multiple hanging points. A single mounting pole may be used to mount the multiple hanging points.

BRIEF DESCRIPTION OF THE DRAWINGS

FIG. 4 is a top plan view of the ceiling clip of FIG. 2;

FIG. 5 is a perspective view of the ceiling clip of FIG. 2 as it is about to be inserted into a channel of a ladderless ceiling mounting device;

FIG. 6 is a cross sectional view of the ceiling clip being inserted into the channel;

DETAILED DESCRIPTION OF THE PREFERRED EMBODIMENTS

Figure 1:
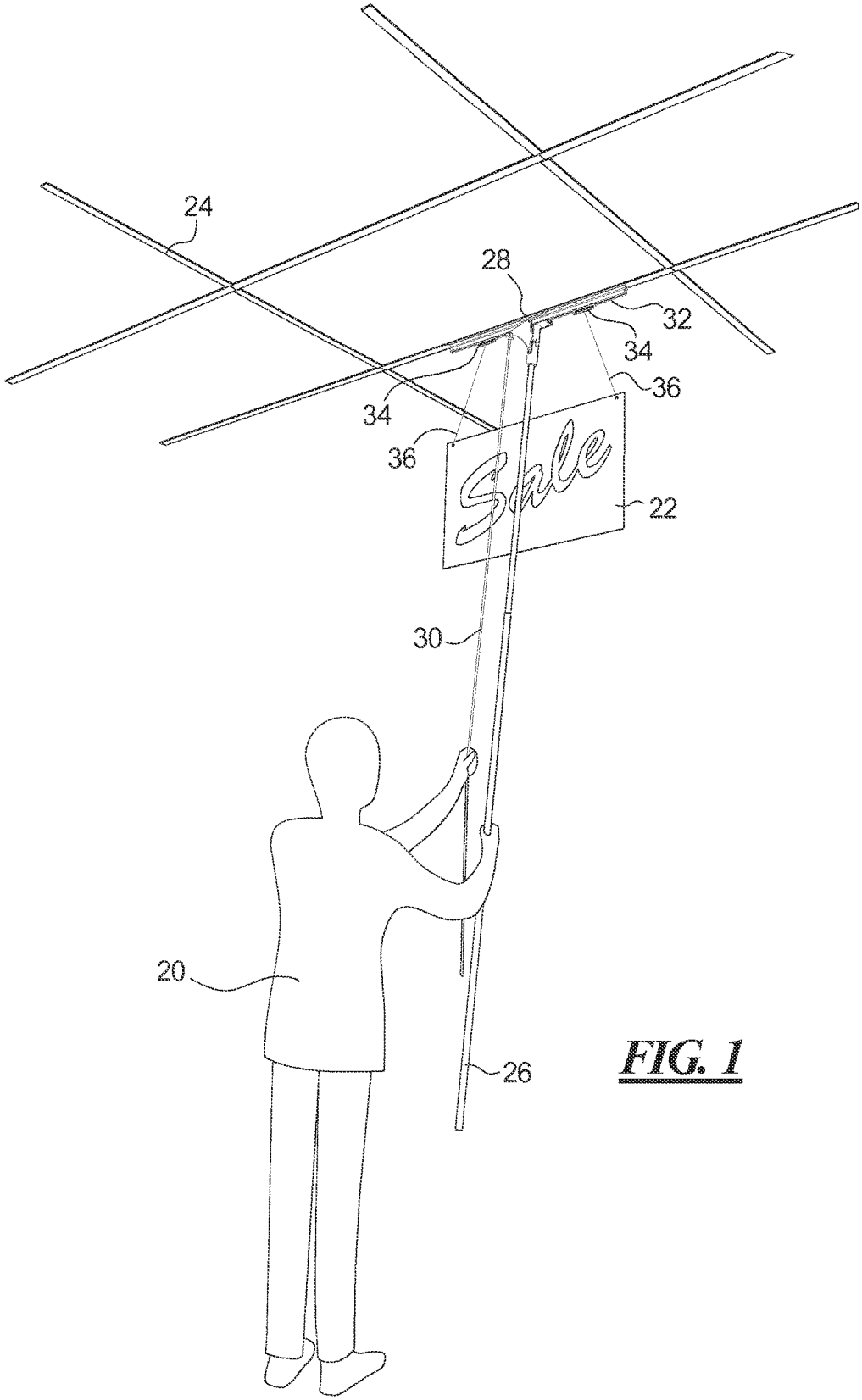
FIG. 1 is a perspective view of a user mounting/dismounting a sign to/from a ceiling using a ladderless system.

In FIG. 1, a person 20 is mounting or removing a sign 22 from a ceiling grid 24 using an elongated pole 26 provided with a gripper 28 at one end. The gripper 28 is operated by a rope 30, for example. The gripper 28 engages a channel 32 that is selectively fastenable to the ceiling grid 24. The channel 32 has two ceiling clips 34 mounted in it. The ceiling clips 34 have lengths of cord 36 that are attached to the sign 22. The sign 22 hangs on the lengths of cord 36, preferably at a position that may be readily noticed. Because the sign 22 is hung from lengths of cord 36, the sign 22 may move about, for example, as a result of a breeze, and thus attract more attention than a stationary sign. The lengths of the cord 36 may be adjusted to a desired placement of the sign from the ceiling 24.

The person 20 may mount the sign 22 to the ceiling grid 24 with a single mounting movement, even though the sign 22 is suspended by multiple hanging points. Similarly, the sign 22, with its multiple hanging points, may be removed from the ceiling grid 24 with a single unmounting movement. The single mounting movement positions the multiple hanging points at the desired spacing without requiring additional movements, and single unmounting movement removes the multiple hanging points without requiring multiple movements. The positions of the ceiling clips 34 in the channel 32, and thus the relative spacing of the clips from one another, may be selected by the person 20 prior to moving the sign 22 and channel 32 into position at the ceiling grid 24. The sign 22 may be suspended in the desired way without requiring that the hanging points be set or changed while the sign is at the ceiling.

In certain embodiments, the channel 32 is mounted to the ceiling grid 24 by magnets on the channel 32. The magnetic attachment of the channel 32 to the ceiling grid 24 while the sign 22 and ceiling clips 34 are mounted therein makes for easy attachment of the sign at the desired location, for example, by positioning the channel 32 against a portion of the ceiling grid 24 so that the magnetic attraction of the magnets on the channel 32 to the magnetically attractive ceiling grid 24 may take hold. Once the channel 32 is in the desired position, the gripper 28 is released from the channel 32 so that the sign 22 remains in place. In the illustrated embodiment, the gripper 28 is released by pulling on the rope 30 to open gripping jaws on the gripper 28. The person 20 moves the pole 26 away from the channel 32 and the channel 32 with the sign 22 suspended from the ceiling clips 34 remains in place.

Removal of the channel 32 and the sign 22 that is mounted therein is a simple matter of grasping the channel 32 with the gripper 28 and tugging on the pole 26 to overcome the magnetic attraction of the channel magnets to the ceiling grid 24. The channel 32 and sign 22 may be removed from its display position, or moved to a new position using the pole 26. Both the movement of the channel 32 and sign 22 to a display position and the removal from the display position may be performed by only using the single pole 26 and without requiring a ladder. In particular, the channel 32 with one or more hanging points provided by the ceiling clips 34 may be mounted to the ceiling grid 24 without the use of a ladder, stepstool, box, crate, or other object to stand on for reaching the mounting location.

When the ceiling clips 34 in the channel 32 are to be mounted to a ceiling that lacks magnetically active ceiling grid elements, the ceiling may be provided with steel mounting plates or steel strips to provide magnetic landing sites to which to attach magnets on the channel 32. In other embodiments, the channel 32 may be mounted to the ceiling grid 24 by clips, grippers, fasteners, or other mounting devices in place of the magnets or in addition to the magnets. Other means for attaching the channel 32 to a ceiling or other surface may be provided. The channel 32 may be constructed to rotate, for example, about a center rotation point, so that the channel 32 and the sign suspended therefrom may be turned to a desired orientation. An example is shown in co-pending U.S. patent application Ser. No. 14/248,899.

The channel 32 with the ceiling clips 34 mounted therein may be mounted to a window frame, wall, exposed ceiling beam, or other structure or mounting location. The mounting of the channel 32 with the ceiling clips 34 may be by magnets, clips, hooks, or other mounting means. The channel 32 with the ceiling clips 34 may be mounted using the elongated pole 26 or may be mounted by hand or by other means.

Figure 2:
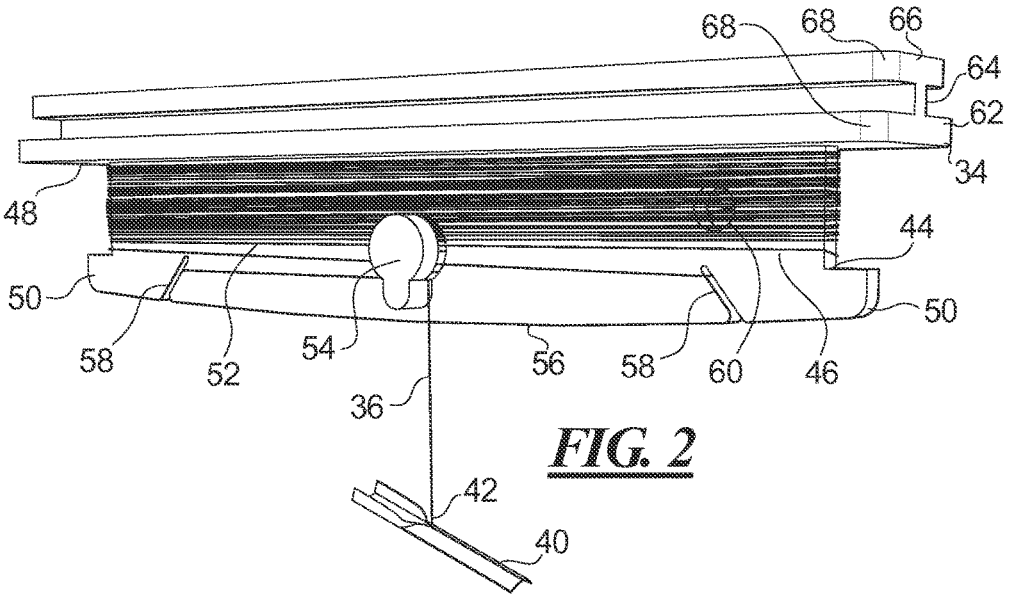
FIG. 2 is a perspective view of a ceiling clip with cord for use in a channel.

Turning to FIG. 2, a ceiling clip 34 on which is mounted a length of cord 36 is shown. The cord 36 is illustrated as a single line for the sake of clarity of the drawing, but has a width in actual practice. The cord 36 may be a cord of natural or polymer fibers, a string, a line such as monofilament line or a braided line, a single strand or multi-strand wire, a chain, a loop-line, a bead chain, twine, or other elongated suspending member. The cord 36 includes a barb 40 that is affixed at a free end 42 of the cord 36 to which may be affixed a sign or display or other elements. For example, the barb 40 may be inserted into an opening in the sign 22 so that the cord 36 passes through the opening and the barb 40 presses against the sign 22 and remains on one side of the sign 22.

Other devices and structures for affixing a sign or display to the cord 36 may be provided. For example, the free end 42 of the cord 36 may be provided with a loop of cord, a ring, a swivel clip, a wire clip, a swivel, a stake eye, a button stop, or other device or structure. The free end 42 of the cord 36 may simply be cut so that the cord 36 may be tied to the sign or display, or the cord 36 may be fitted into a cord gripper or other element on the sign or display or otherwise held at the sign or display. The cord 36 may be provided with a branching end that separates into multiple free ends. The barb 40 is shown as a light duty barb that is formed onto the end of the cord. A heavy duty cord and heavy duty barb may be provided in some embodiments.

The ceiling clip 34 includes a spool portion 44 on which is wound the cord 36 when the ceiling clip 34 is not being used. The spool portion 44 also stores any unused portion of the cord 36 while the ceiling clip 34 is being used. In the illustrated embodiment, the spool portion 44 includes a planar portion 46 extending from and affixed to a base 48. At the opposite side of the planar portion 46 from the base 48 is a pair of projections 50 that prevent wound portions 52 of the cord 36 from slipping off the spool portion 44. The spool portion 44 includes a line clip 54 into which the cord 36 is clipped. The line clip 54 supports the free end 42 of the cord 36 and any display or sign suspended from the cord 36 while preventing wound portions 52 of the cord 36 from unwinding from the spool portion 44.

The length of the cord 36 that extends from the line clip 54 to the free end 42 at the barb 40 is determined by how much of the cord 36 is unwound from the wound portion 52 on the spool 44. To obtain a greater length of cord 36 extending from the ceiling clip 34, the cord 36 is unclipped from the line clip 54, unwound by one or more turns from the spool portion 44 and reinserted into the line clip 54. Shortening the cord 36 is performed by removing the cord 36 from the line clip 54, winding the cord 36 by one or more wraps on the spool portion 44, and reinserting the cord 36 in the line clip 54. The suspended cord 36 may be increased or decreased in length in increments corresponding to one wrap on the spool portion 44.

A lower edge 56 of the spool portion 44 includes angled slots 58 into which the cord 36 may be inserted. The angled slots 58 permit changes in the extended length of cord 36 in increments less than the length of one wrap on the spool portion 44. The distance of the sign or display below the ceiling clip 34 may be adjusted in small increments by positioning the cord 36 in one or more of the slots 58.

An opening 60 is provided in the spool portion 44 for fastening an opposite end of the cord 36 to the ceiling clip 34. The limit to which the cord 36 may be unwound from the ceiling clip 34 is determined by the length of the cord 36 between the free end 42 and the opposite end at the opening 60. The cord length may be as long or short as desired.

The ceiling clip 34 has the base 48 to which the spool portion 44 is affixed. The base 48 includes a first elongated flange 62 extending perpendicular to the planar portion 46 of the spool 44, a connecting web 64 extending generally co-planar to the planar portion 46, and a second elongated flange 66 that is generally parallel to the first elongated flange 62. The base 48 extends longitudinally beyond the spool portion 44 at both ends thereof. The first and second elongated flanges 62 and 66 extend perpendicularly from both planar surfaces of the plane defined by the planar portion 46 of the spool 44. The base 48 mounts the ceiling clip 34 in a channel 32 as will be described. The corners of the first flange 62 and second flange 66 are beveled at 68.

The line clip 54 keeps the wound portions of the cord 36 on the spool portion 44 of the ceiling clip 34 while supporting the suspended portion of the cord that has been unwound from the spool portion 44. The line clip 54 must be sufficiently strong to hold the weight of the sign or display, or if multiple ceiling clips are used, to support a fractional part of the weight. The line clip may be configured to engage the cord snuggly or may merely hold the cord.

Figure 3:
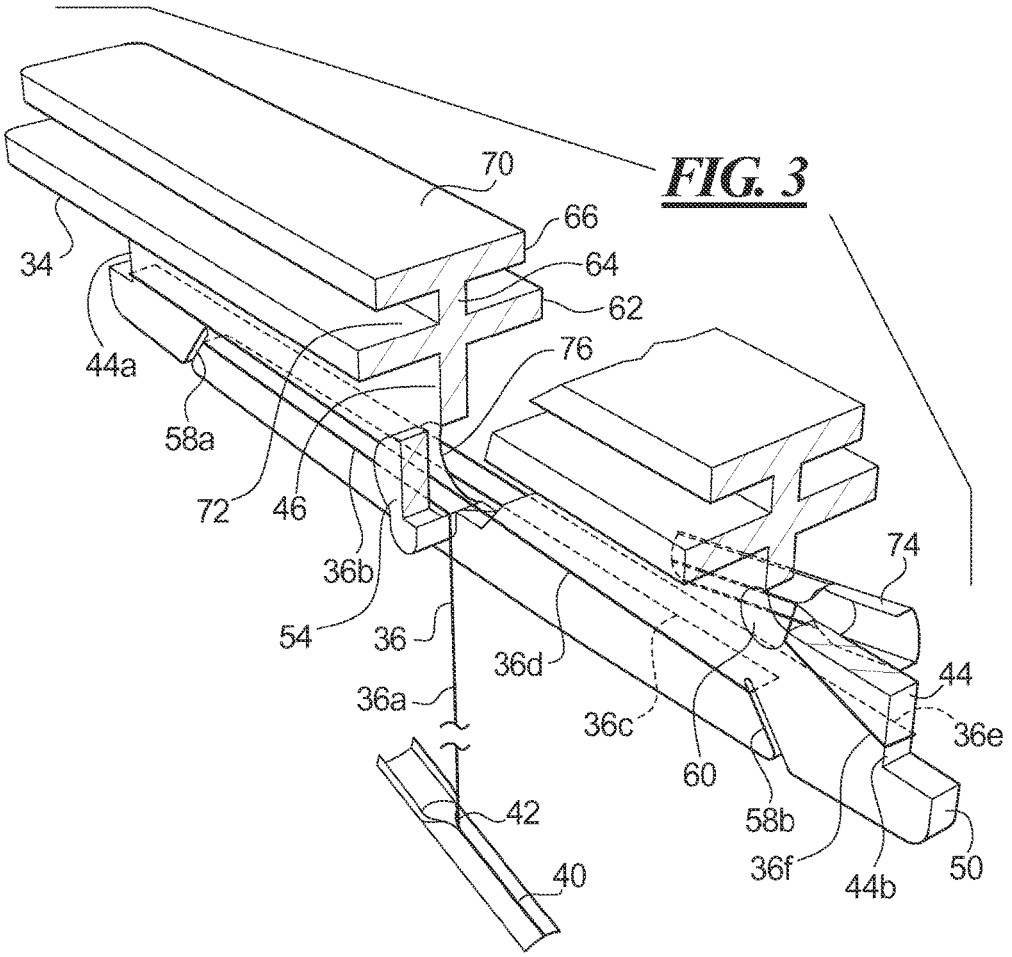
FIG. 3 is a perspective view, partially cut away, of the ceiling clip of FIG. 2.

In FIG. 3, the ceiling clip 34 has been partially cut away to reveal the relative shapes of the first and second elongate flanges 62 and 66. The second elongated flange 66 forms a top surface 70 of the ceiling clip 34. In the illustrated embodiment, the top surface 70 is flat and relatively smooth. The first elongated flange 62 extends in a perpendicular direction by a first distance from the plane of the connecting web 64 and the planar portion 46. The second elongated flange 66 extends in a perpendicular direction by a second distance from the plane of the connecting web 64 and planar portion 46; the second distance being less than the first distance in certain embodiments. Said another way, the first flange 62 is wider than the second flange 66. The first flange 62 and the second flange 66 are spaced apart by a gap distance to define a space 72 between the flanges 62 and 66.

The cord 36 extends by a first cord segment 36*a* from the barb 40 to the line clip 54 by a desired distance to hang a sign or display from the ceiling clip 34. The cord 36 is wrapped in a second cord segment 36*b* from the line clip 54 to a first slot 58*a*, the cord 36 passes through the slot 58*a* to a third cord segment 36*c* that extends behind the spool portion 44 (relative to the illustration of FIG. 3) and through a second slot 58*b*. After passing through the second slot 58*b*, a fourth cord segment 36*d* extends from the second slot 58*b* to a first end 44*a* of the spool 44, wraps around the first end 44*a* of the spool 44 to a fifth cord segment 36*e* behind the spool portion 44 to a second end 44*b* of the spool 44. The cord 36 may wrap around the spool 44 as many times as necessary to take up the unused length. In the illustration, the cord 36 extends from the second spool end 44*b* in a sixth cord segment 36*f* to the opening 60. On the other side of the opening 60 is a second barb 74 that prevents the cord 36 from being pulled through the opening 60. By positioning the cord 36 through the first and second slots 58*a* and 58*b*, the length of the cord wound on the spool 44, and thus the length of the cord 36 extending from the ceiling clip 34, may be adjusted in increments less than one wrap of the spool 44.

The line clip 54 extends out of the plane of the planar portion 46. To facilitate molding of the ceiling clip 34, an opening 76 is formed in the planar portion 46 at the line clip 54. The opening 76 need not be provided if not required by molding or forming techniques for the ceiling clip 34.

With reference now to FIG. 4, a top view of the ceiling clip 34 shows the smooth top surface 70 of the second elongate flange 66 and the wider first elongated flange 62 extending from both sides of the narrower second flange 66. The sides 80 of the first elongated flange 62 of certain embodiments are generally parallel and straight. The sides 82 of the second elongated flange 66, on the other hand, include tapered end portions 84. A slight narrowing of the second flange 66 at one or both ends is provided to facilitate insertion of the ceiling clip 34 into a channel 32. The sides 82 of the second flange 66 between the tapered end portions 84 is of a width to fit snuggly, and provide frictional resistance to free movement of the ceiling clip 34 in the channel 32. The taper angle of the tapered end portions 84 is at a shallow angle, for example, at an angle of approximately one degree, although angles of more or less than one degree are within the scope of this invention.

FIG. 5 shows the ceiling clip 34 being inserted into the channel 32. The channel 32 may be formed by extruding and so may be referred to as an extruded channel. Other configurations and methods of forming the channel are within the present invention. The channel 32 has a channel portion 78 including a top wall 86, side walls 88, and inwardly directed bottom wall portions 90 that define a gap 92 therebetween. The channel portion 78 has an interior space 94. The ceiling clip 34 is positioned so that the second elongated flange 66 extends into the interior space 94 and the wider, first elongated flange 62 is disposed outside the space 94. The inwardly directed bottom wall portions 90 fit into the spaces 72 between the first and second flanges 62 and 66. The spaces 72 of certain embodiments are sufficiently large to permit the bottom wall portions 90 to move without restriction as the ceiling clip 34 is moved along the channel 32.

The channel 32 of the illustrated embodiment includes a connecting web 96 extending to a top plate 98. The top plate 98 has one or more magnets 100 mounted thereon, such as by glue. The magnets 100 engage ferromagnetic materials such as the ceiling grid 24, metal plates, metal strips, window frames, or other mounting locations. The magnets of certain embodiments are ceramic magnets mounted within a metal frame. Other magnets are possible, including extruded magnets, rubber magnets, and the like. The top plate 98 may be provided with clips, fasteners, or other devices for mounting the channel 32 to a mounting location. The gripper engagement portion, or T-bar, may be offset alongside the channel so that the gripper engagement portion may be gripped by the pole end gripper without requiring a space above the display or sign for the gripper engagement. The offset gripper portion permits the sign or display to be mounted tight to the ceiling, or to be mounted at a perimeter of the ceiling against a wall or on the wall. Mounting the channel to a ceiling, wall, exposed beam, window, window frame, or other mounting location is within the scope of this invention.

The connecting web 96 of certain embodiments is provided with a high friction coating 102 to enable the gripper 28 on the elongated pole 26 to grip the channel 32 without slipping. Other embodiments of the channel and/or gripper are possible, including mounting the channel by hand.

In FIG. 6, the ceiling clip 34 is being inserted into the channel 32. In particular, the second elongated flange 66 at the top of the ceiling clip 34 is being inserted between the side walls 88 of the channel portion 78. The first elongated flange 62 remains outside the channel portion 78. The side walls 88 are at a predetermined spacing from one another, and the width of the second flange 66 is such that the second flange 66 frictionally engages the inside surfaces of the side walls 88. The tapered end portions 84 of the second flange 66 reduces or prevents friction between the side walls 88 and the second flange 66 as the ceiling clip 34 is first being inserted so that the insertion process is easy. The second flange 66 engages the sidewalls 88 in full frictional engagement only in a middle portion of the ceiling clip 34, which provides sufficient resistance to movement to keep the ceiling clips 34 in the desired positions in the channel 32 even when a sign 22 or other display is hung therefrom and while the channel 32 with the ceiling clips 34 and display elements are being moved into display position and while being moved from the display position. The force to move the ceiling clip 34 along the channel 32 is such that a user may move the ceiling clip 34 to a position relatively easily. In certain embodiments, the dimensions of the second flange 66 of the ceiling clip 34 are carefully selected to cooperate with the channel 32 to achieve this result.

Figure 7:
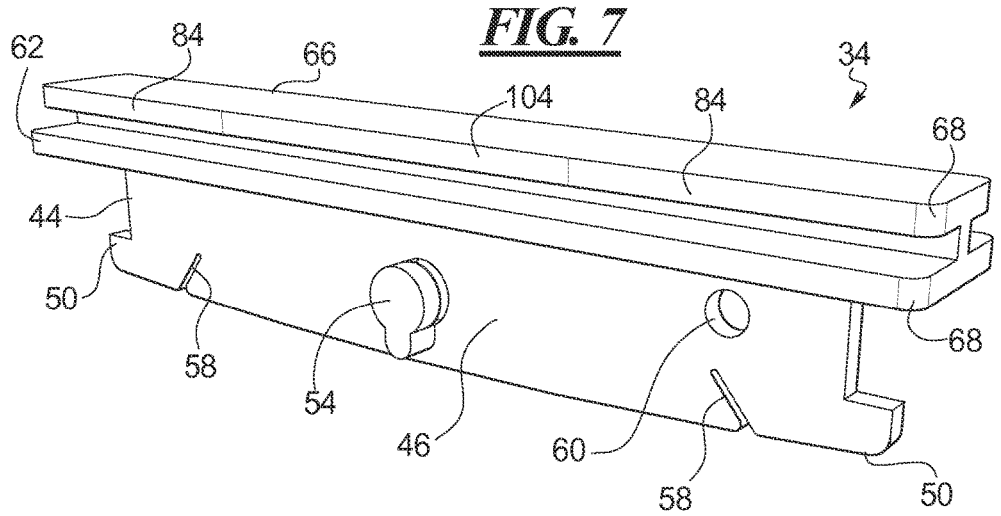
FIG. 7 is a perspective view of the ceiling clip of FIG. 2, shown without the cord.

FIG. 7 shows the ceiling clip 34 without the cord. The second flange 66 has the beveled corners 68 and the tapered end portions 84 to facilitate insertion into and movement along the channel 32. The second flange 66 has a middle portion 104 between the tapered ends 84 that provides the frictional engagement with the side walls 88 of the channel 32. The first flange 62 is below the second flange 66 by a distance to accommodate the inwardly directed wall portions 90. The planar portion 46 extends from the first flange 62 in a direction opposite the second flange 66 and provides the spool portion 44 with the opening 60, the line clip 54, and the angled slots 58.

Figure 8:
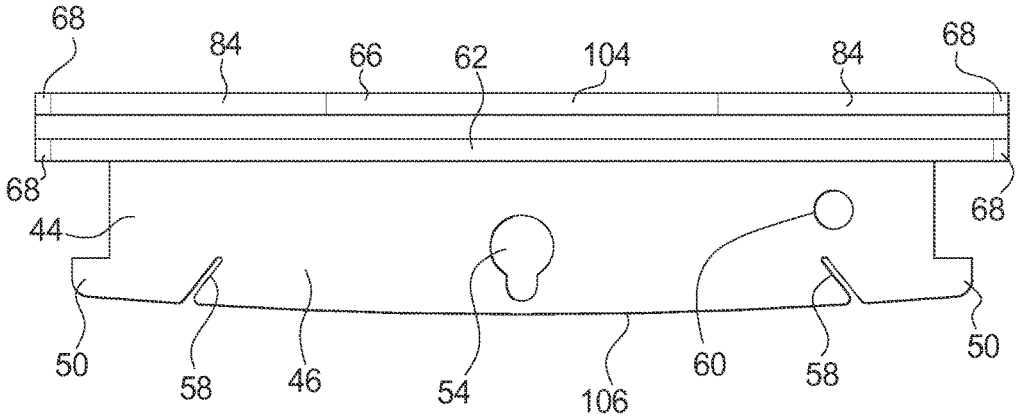
FIG. 8 is a side elevational view of the ceiling clip of FIG. 7.

In FIG. 8, the elongated flanges 62 and 66 are of a greater length than the planar portion 46, extending beyond even the projections 50 of the spool portion 44. A lower edge 106 of the planar portion 46 is curved to extend further from the flanges 62 and 66 at the middle than at the ends. The curved lower edge 106 may facilitate insertion of the cord 36 into the angled slots 58.

Figure 9:
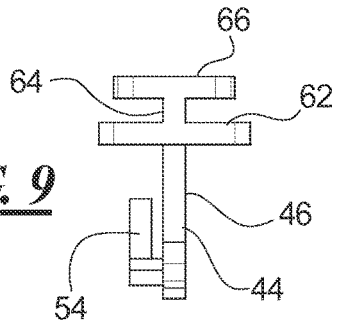
FIG. 9 is an end elevational view of the ceiling clip of FIG. 7.

FIG. 9 shows the relative widths of the first and second flanges 62 and 66 as well as the position of the line clip 54 below the flanges. The connecting web 64 is co-planar with the planar portion 46 that includes the spool portion 44.

Figure 10:
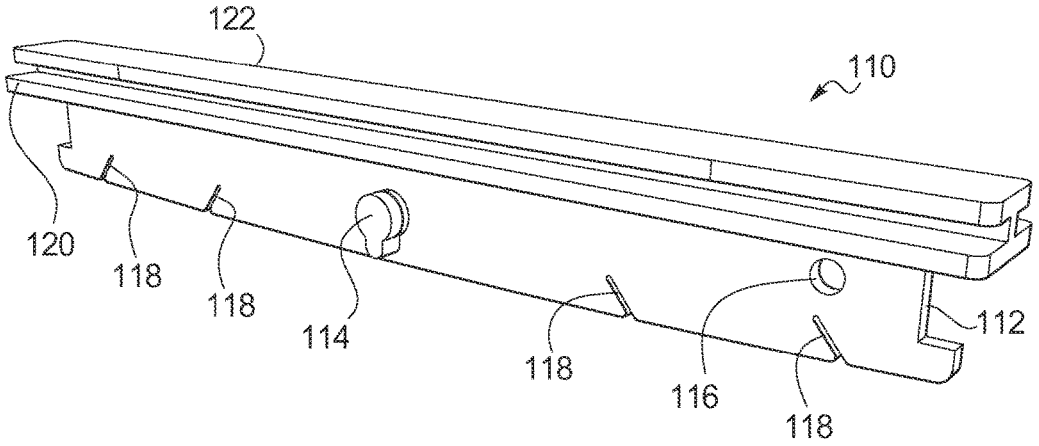
FIG. 10 is a perspective view of a second embodiment of a ceiling clip.

With reference to FIG. 10, a further embodiment of a ceiling clip 110 is provided. The ceiling clip 110 includes a spool portion 112 on which may be wound a cord, line, bead chain, or other elongated member, a line clip 114 for holding the cord, chain, or line, and an opening 116 for attaching the cord or the like to the ceiling clip 110. The ceiling clip 110 includes four angled slots 118 into which the cord may be inserted to vary the length of the cord extending from the ceiling clip 110 in smaller increments. The cord may be inserted into any of the angled slots 118 or into several of the angled slots 118 to vary the hanging cord length. The ceiling clip 110 has a first elongated flange 120 and a second elongated flange 122. The overall length of the ceiling clip 110 is greater than the embodiment shown in FIG. 7 so that the spool portion 112 is longer and the length or size of cord that may be wound on the spool portion 112 is greater. The greater length of the spool portion 112 also means that the incremental length of cord that may be wound or unwound on the spool for hanging a sign or display is greater or that the cord size itself is greater. The four angled slots 118 permit the increments of cord length being wound or unwound to be broken into smaller increments so that the sign or display hanging distance can be adjusted to in smaller amounts.

Figure 11:
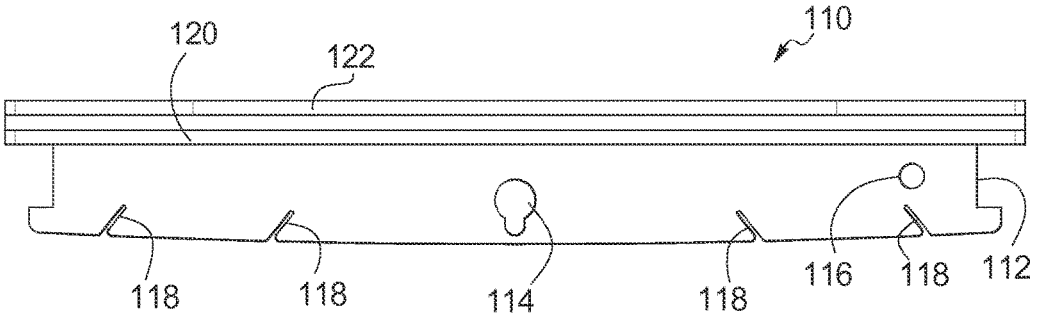
FIG. 11 is a side elevational view of the ceiling clip of FIG. 10.

FIG. 11 shows that the overall shape of the further embodiment 110 is similar to the embodiment of FIG. 7 except that more angled slots 118 are provided and the length is greater. Other changes in length and/or changes to accommodate more finely spaced increments of hanging cord length are possible and within the scope of the present invention. For example, more or fewer angled slots may be provided.

Figure 12:
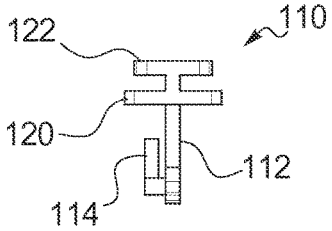
FIG. 12 is an end elevational view of the ceiling clip of FIG. 10.

In FIG. 12, the second flange 122 and the spacing between the second flange 122 and the first flange 120 are configured such that the ceiling clip 110 will fit into the channel 32. The ends of the second flange 122 are tapered for easy insertion and the middle portion is of a width to engage a position and stay put while the sign or display is being mounted or unmounted, yet is movable to a different position by a user.

Figure 13:
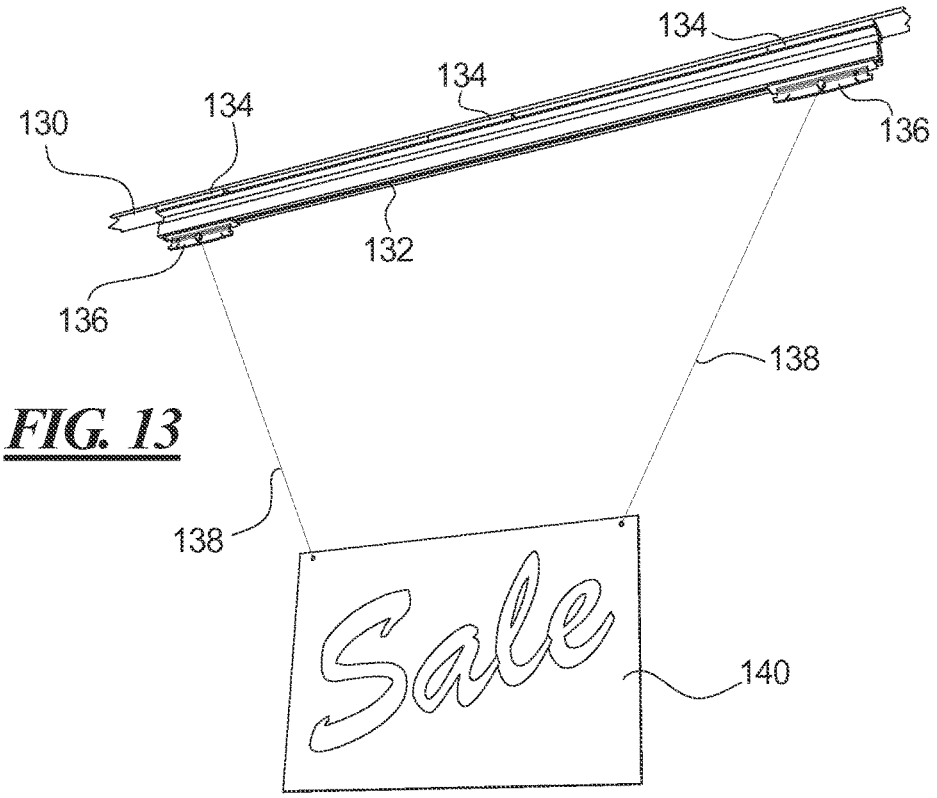
FIG. 13 is a perspective view of a sign hung from ceiling clips mounted in a channel of a ladderless mounting system.

Turning to FIG. 13, a ceiling grid member 130 is formed of a metal that is attractive to magnets. A channel 132 has three magnets 134 attached to the top surface thereof and has been positioned at the ceiling grid member 130 so that the channel 132 is attached to the ceiling of the room or area of a building. Ceiling clips 136 are mounted in the channel 132 adjacent the ends thereof. A cord 138 on each ceiling clip 136 has been unwound to extend a predetermined distance from the ceiling clips 136. A sign 140 is suspended from the cords 138. The sign 140 extends over a shorter length than the spacing of the ceiling clips 136 in the channel 132. The spacing results in tension being applied to the sign 140, which may keep the sign 140 straight and prevent curling or bending, for example. The length of cord 138 from the ceiling clips 136 may be adjusted to suspend the sign 140 at the desired height or spacing from the ceiling while maintaining the tension on the sign 140.

The alternative spacing of the ceiling clips closer together than the hanging points of the sign, as shown in FIG. 1, applies a compressive force to the sign, which may be overcome by a stiff sign material or added stiffener to the sign, or that may be desired in some instances. The closer spacing of the ceiling clips than the sign hanging points may result in an increase in movement by the sign, for example, swaying and/or twisting, which may be desirable to attract attention, for example.

Figure 14:
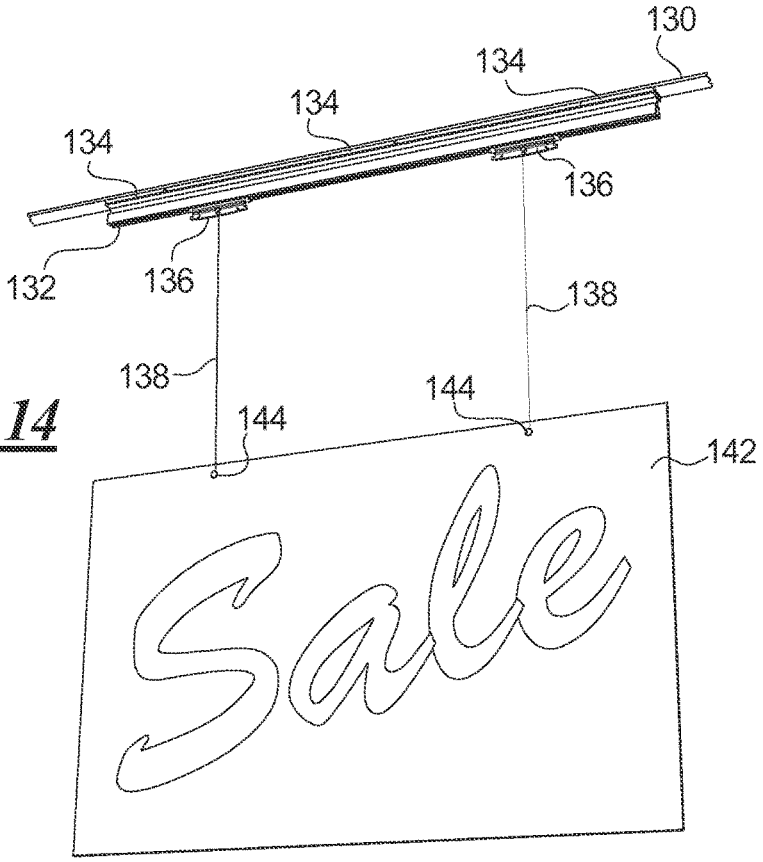
FIG. 14 is a perspective view of a sign hung from ceiling clips spaced at the same spacing as the mounting locations of the sign.

FIG. 14 shows a sign 142 having suspension points 144, which are openings in which cords are attached, at a predetermined spacing. The ceiling clips 136 have been set to the predetermined spacing so that the cords 138 hang directly down from the ceiling clips 136 to the openings 144 in the sign 142. The sign 142 may be of stiffer material or may be provided with a stiffener or reinforcing member to prevent bending or curling while hanging. The ceiling clips 136 may be adjusted as to position in the channel 132 and length of suspended cord 138 prior to mounting of the channel 132 at the ceiling grid element 130. The mounting and unmounting of the channel 132 from a ceiling grid 130 in either FIG. 13 or 14 is performed with a single motion while maintaining the desired positions of the ceiling clips 136.

The adjustable length of the suspending cords 138 permit the sign 132 to be hung at an angle, such as to provide an eye catching display or to direct attention to some product or area of a store, for example. The angle of the display may be fine tuned as desired by adjusting the cord lengths and the spacings of the ceiling clips.

Figure 15:
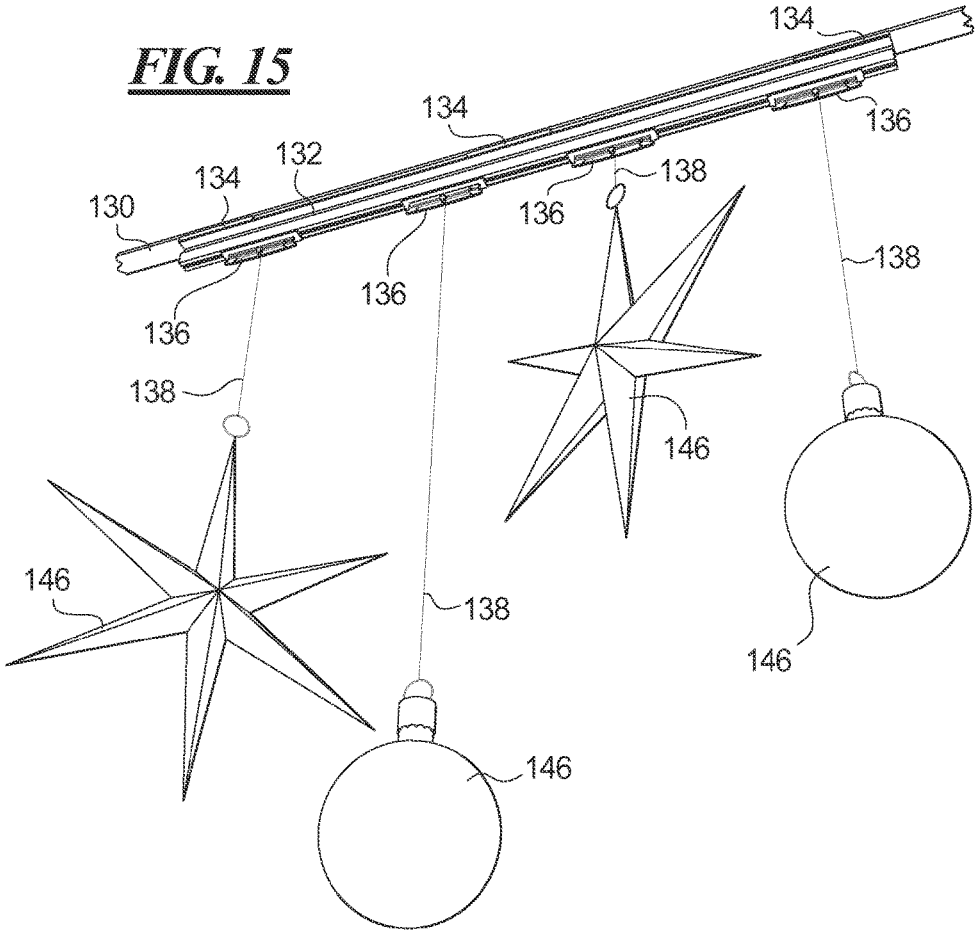
FIG. 15 is a perspective view of a display of multiple elements suspended from a single channel.

As shown in FIG. 15, a plurality of ceiling clips 136 is provided in a single channel 132. Each ceiling clip 136 suspends a display element 146 from a cord 138. The display elements 146 are separately suspended at different distances from the ceiling grid member 130 by extending different lengths of the cords 138. All of the display elements 146 may be mounted at the same time, at the desired spacing, and at the desired individual heights by a single mounting movement. All of the display elements 146 may be unmounted at the same time by a single unmounting movement. The user 20 may mount all of the display elements 146 using the gripper 28 on the pole 26 to position the magnets 134 of the channel 132 at the ceiling grid element 130. Once the ceiling clips 136 and the display elements are positioned prior to mounting, no adjustment of the positions of the display elements relative to one another is necessary after the mounting movement at the ceiling. Ceiling mounted displays are much easier to set up and take down given one single mounting, unmounting motion.

Multiple channels 132 may be provided to mount multiple display elements to a ceiling, either in a row along a ceiling grid element, at multiple ceiling grid elements, or at multiple locations by otherwise mounting the channels. Each of the channels 132 may be provided with multiple display elements 146 or signs 140 or with a single display element 146 or sign 140. Via the use of pivoting channels (see the co-pending application), magnetic mounting plates (see the co-pending application), clips, hooks, or other means for mounting the channels, any variety of single or multiple sign or display elements may be mounted easily and at desired positions and desired relative spacings from one another.

Figure 16:
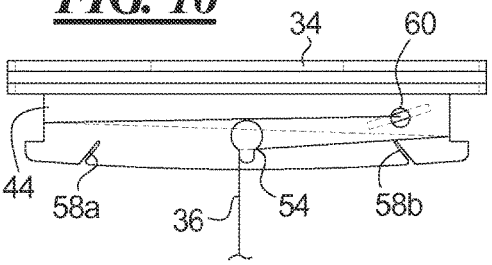
FIG. 16 is a side view of a ceiling clip showing a first position of a cord.

FIGS. 16 through 19 provide examples of adjustments in the suspended cord length from a ceiling clip at various increments. In FIG. 16, a ceiling clip 34 has the cord 36 mounted in the opening 60 and wrapped once around the spool portion 44, affixed in the line clip 54 and extending downward to the hanging sign or display element. The cord 36 may be wrapped multiple times around the spool portion. Each wrap onto or unwrap from the spool provides increments of one spool wrap length for changes in the cord length from the ceiling clip. Different sizes of ceiling clips result in different spool wrap lengths, but for a given ceiling clip the increment of a spool wrap length is fixed.

Figure 17:
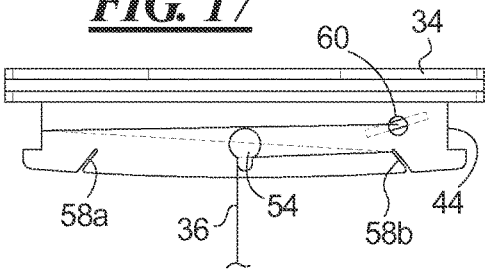
FIG. 17 is a side view of a ceiling clip showing a second position of a cord.

As seen in FIG. 17, the cord 36 is fastened in the opening 60 and is wrapped from the spool portion 44 to the second angled slot 58*b* and then to the cord clip 54. The increment of cord length extending from the ceiling clip 34 is different from a full spool wrap by twice the distance from the end of the spool portion 44 to the angled slot 58*b*. Full spool cord wraps may be provided on the spool 44. Additional angled slots may be provided for varying the extended length by other increments, as shown herein.

Figure 18:
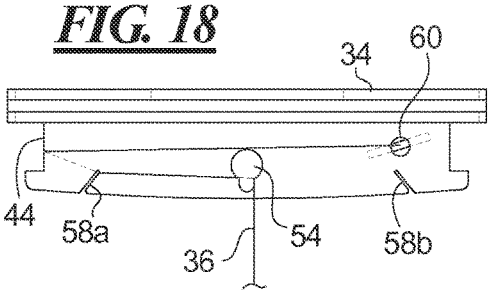
FIG. 18 is a side view of a ceiling clip showing a third position of a cord.

FIG. 18 shows the cord 36 fastened in the opening 60, wrapped to the end of the spool portion 44 and passing through the first angled slot 58*a* and then to the line clip 54. The increment of cord length extending from the ceiling clip 34 differs from a full spool cord wrap by approximately one half the length of a full spool wrap. Full spool wraps may be provided on the spool portion 44.

Figure 19:
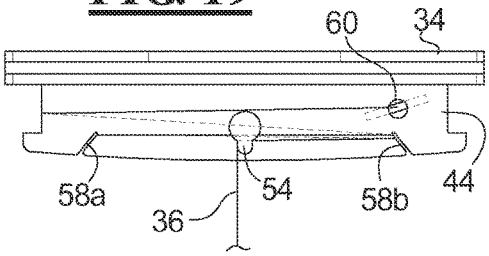
FIG. 19 is a side view of a ceiling clip showing a fourth position of a cord.

Lastly, FIG. 19 shows the cord 36 fastened in the opening 60 and wrapped on the spool portion 44 to the second angled slot 58*b* then to the first angled slot 58*a* and back to the second angled slot 58*b* and finally to the line clip 54. The increment of cord adjustment compared to a full spool wrap is approximately four times the distance from the end of the spool portion 44 to the angled slots 58. Additional angled slots in the ceiling clip provide additional variations in the cord extending length. Full spool wraps may be provided on the spool portion 44.

Other variations in wrapping and fastening the cord in the ceiling clip 34 may be possible. Other variations in the ceiling clip, such as the addition of further angled slots in the ceiling clip, or the addition of further line clips at positions along the planar portion of a ceiling clip, may be provided. For example, the line clips may provide a plurality of possible clipping locations for the cord.

The ceiling clip of certain embodiments permits a user to mount adjustable length dangling displays and signs from a channel. The ceiling clips in the channel permit, in certain embodiments, the mounting and unmounting of the display with a single motion to affix the channel to mounting locations such as a ceiling, beam, window, or other mounting location and without requiring separate positioning and mounting of the ceiling clips individually. The ceiling clips of certain embodiments may be spaced as desired in the channel.

The present ceiling clip as described herein may provide a system for mounting a sign or display, wherein the system includes, for example, a channel and at least one ceiling clip as well as a means for mounting the channel at a display location. The present ceiling clip as described here includes, for example, a method for mounting a sign or display.

The spool portion shown herein is generally planar and horizontal in direction. It is within the scope of this invention to provide a spool portion that is cylindrical, elliptical, of other shapes, or vertical in direction. The line clip is shown in a particular shape. Other shapes and configurations of line clips are within the scope of this invention. The first flange is shown as a generally rectangular, elongated portion. It is within the scope of the invention that the first flange may be of any shape, or may be eliminated altogether.

The second flange is shown as an elongated member having two portions extending from opposite sides of the connecting web. Other configurations of the second flange are possible and within the scope of this invention. The ceiling clip is shown with two or four angled slots. At least three slots may be provided in some embodiments, while other embodiments may have only one slot or more than four slots. The first and second flanges are spaced apart a distance sufficient to receive the inwardly directed portions of the channel.

Although other modifications and changes may be suggested by those skilled in the art, it is the intention of the inventors to embody within the patent warranted hereon all changes and modifications as reasonably and properly come within the scope of their contribution to the art.

I claim:

1. A ceiling clip for suspending a sign or display, comprising:

a spool portion configured to receive a plurality of wraps of an elongated support wound around and onto the spool portion so as to store a portion of the elongated support as the plurality of the wraps on the spool portion;

a line clip connected to the spool portion, the line clip being constructed to engage the elongated support to prevent unwinding of the plurality of wraps of the elongated support wound on the spool portion while supporting an unwound portion of the elongated support;

a first elongated flange connected to the spool portion, the first elongated flange being of a first length in a longest dimension of the first elongated flange;

a connecting web connected to the first flange, the connecting web being of the first length; and a second flange connected to the connecting web, the second flange having a shape to fit into a channel, the second flange being of the first length.

2. A ceiling clip as claimed in claim 1, wherein the second flange is tapered at one or at both ends.

3. A ceiling clip as claimed in claim 2, wherein the second flange is generally rectangular in shape and is tapered at two opposite ends of the rectangular shape.

4. A ceiling clip as claimed in claim 1, wherein the spool portion includes a generally planar portion having an edge opposite the first flange, the edge opposite the first flange being shaped to define a plurality of angled slots.

5. A ceiling clip as claimed in claim 4, wherein the plurality of angled slots includes four angled slots.

6. A ceiling clip as claimed in claim 1, wherein the first and second flanges are spaced apart by a distance to accept inwardly directed portions of a channel.

7. A ceiling clip as claimed in claim 1, wherein the elongated support is one of a cord, string, line, chain, bead chain, twine, wire, or other elongated suspending member.

8. A sign or display mounting system, comprising:

a channel having a mounting portion and a channel portion, the channel portion including an elongated portion defining an interior channel space and an elongated slot;

a ceiling clip having:

a planar spool portion having a length;

an elongated support wound on the spool portion, the elongated support having a free end for mounting a sign or display;

a line clip connected to the spool portion, the line clip being configured to receive the elongated support and prevent unwinding of the elongated support from the spool portion;

a flange connected to the spool portion, the flange being shaped to fit into the interior channel space of the channel portion, the flange having a length at least as great as the length of the planar spool portion;

a connecting web connecting the flange to the spool portion, the connecting web extending through the elongated slot in the channel portion when the flange is in the interior channel space of the channel portion so that the spool portion is disposed externally of the channel portion.

9. A sign or display mounting system as claimed in claim 8, further comprising:

a plurality of ceiling clips mounted in the channel.

10. A sign or display mounting system as claimed in claim 8, wherein the ceiling clip includes first and second flanges connected to one another by the connecting web, the flange shaped to fit into the interior space of the channel portion being the second flange, the first flange being disposed outside the channel portion when the second flange is mounted in the channel portion.

11. A sign or display mounting system as claimed in claim 10, wherein the first flange extends from the connecting web by a greater distance than the second flange so that the first flange has a greater width than the second flange.

12. A sign or display mounting system as claimed in claim 8, wherein the spool portion includes a plurality of angled slots configured for receiving the elongated support.

13. A sign or display mounting system as claimed in claim 11, wherein the plurality of angled slots includes four angled slots.

14. A sign or display mounting system as claimed in claim 8, wherein the flange includes at least one tapered end.

15. A sign or display mounting system as claimed in claim 14, wherein the flange includes two tapered ends.

16. A sign or display mounting system as claimed in claim 8, wherein the elongated support is one of a cord, a line, a string, a chain, a bead chain, a wire, or other elongated member.

17. A ceiling clip for suspending a sign or display, comprising:

a planar spool portion adapted to receive an elongated support, the planar spool portion being of a first length;

a line clip connected to the spool portion, the line clip being constructed to engage the elongated support to prevent unwinding of portions of the elongated support wound on the spool portion while supporting an unwound portion of the elongated support;

a first elongated flange connected to the spool portion, the first elongated flange being of a length greater than the first length;

a connecting web connected to the first flange, the connecting web being of a length greater than the first length; and a second flange connected to the connecting web, the second flange having a shape to fit into a channel, the second flange being of a length greater than the first length.

* * * * *